US005195839A

United States Patent [19]

Wicklund et al.

[11] Patent Number: 5,195,839

[45] Date of Patent: Mar. 23, 1993

[54] INTERCONNECTED FRAME ASSEMBLY

[75] Inventors: Eric Wicklund, Burnsville; Sue Oleson, Savage; Bryan J. Beaulieu, Burnsville, all of Minn.

[73] Assignee: Skyline Displays, Inc., Burnsville, Minn.

[21] Appl. No.: 842,464

[22] Filed: Feb. 27, 1992

[51] Int. Cl.[5] ..... B65D 59/00

[52] U.S. Cl. ..... 403/12; 403/170; 403/217

[58] Field of Search ..... 403/12, 170, 174, 178, 403/217; 135/106, 107

[56] References Cited

U.S. PATENT DOCUMENTS 4,846,205 7/1989 Knoll ..... 135/106

4,934,858 6/1990 Beaulieu ..... 403/12 X

FOREIGN PATENT DOCUMENTS 365496 12/1962 Switzerland ..... 135/106

*Primary Examiner*—Andrew V. Kundrat

*Attorney, Agent, or Firm*—Palmatier, Sjoquist & Helget

[57] ABSTRACT

A frame assembly for a display structure formed of a plurality of tubular support members joined end to end. An elastic cord is permanently connected in and winds its way through the tubular support members so that the support members are joinable in only one predefined arrangement to facilitate set up of the frame assembly. Some of the end-to-end connections include key and keyhole connections with apertured keys through which the elastic cord extends.

13 Claims, 3 Drawing Sheets

INTERCONNECTED FRAME ASSEMBLY

BACKGROUND OF THE INVENTION

The present invention relates to a frame assembly for a display structure and, more particularly, to an interconnected frame assembly having tubular support members and also having an elastic cord permanently connected in and winding through at least some of the tubular support members to facilitate set up of the frame assembly.

A frame assembly for a display structure may consist of a relatively great number of support members to be interconnected together to set up the frame assembly. Conventionally, the ends of the support members may be marked alphabetically or numerically to match ends which are to be connected. Such a set up process is slow, especially at the beginning of the process when a great number of ends are typically considered before an end-to-end match is found.

The Beaulieu U.S. Pat. No. 4,934,858 entitled Fastening Device for Support Structures discloses an elastic cord fed through the interior of one or more vertical members to couple the vertical members in a resilient end-to-end relationship, in much the nature of assembly of supporting struts for camping tents. Beaulieu discloses that such a relationship permits the requisite number of vertical members to be loosely held together and oriented, and facilitates the ultimate assembly and disassembly of a display frame.

SUMMARY OF THE INVENTION

An object of the present invention is to provide means for facilitating the set up of a frame assembly having angularly oriented members for a display structure.

Another object is to provide means for predefining and permanently matching the relative orientations of support members which are to be angularly disposed relative to each other.

A feature of the present invention is an elastic cord winding through a great majority of the support members of a frame assembly for a display structure. The elastic cord permanently maintains a predefined arrangement of the support members even when the support members are structurally disconnected from each other. For set up of the frame assembly, the respective ends to be connected to each other are defined by the elastic cord extending between the ends. Even exact orientations between support members are defined by an elastic cord extending between respective apertured keys and keyholes on and in the ends of adjacent support members.

An advantage of the present invention is that frame assemblies may be set up quickly.

Another advantage is that the frame assembly may be set up into only one configuration. The chances of mismatching ends or relative orientations of support members is minimal or none.

Another advantage is that the frame assembly is easy to disassemble even with the elastic cord permanently wound throughout the support members.

Another advantage is that the frame assembly is easy to store in a relatively compact form even with the elastic cord permanently wound throughout the support members.

DETAILED DESCRIPTION OF THE PREFERRED EMBODIMENTS

Figure 1:
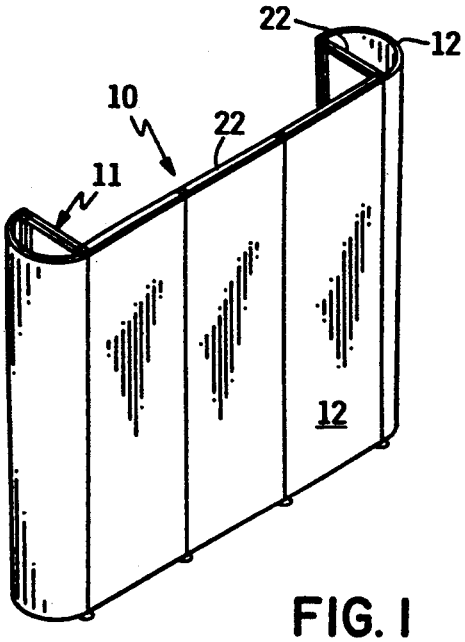
FIG. 1 is an isometric view of a display structure supported by the present frame assembly.

As shown in FIG. 1, a display structure 10 includes a frame assembly 11 for supporting a set of fabric-like skin panels 12 for mounting on the frame assembly 11. The display structure 10 may serve as a backdrop to a trade show booth.

Figure 2:
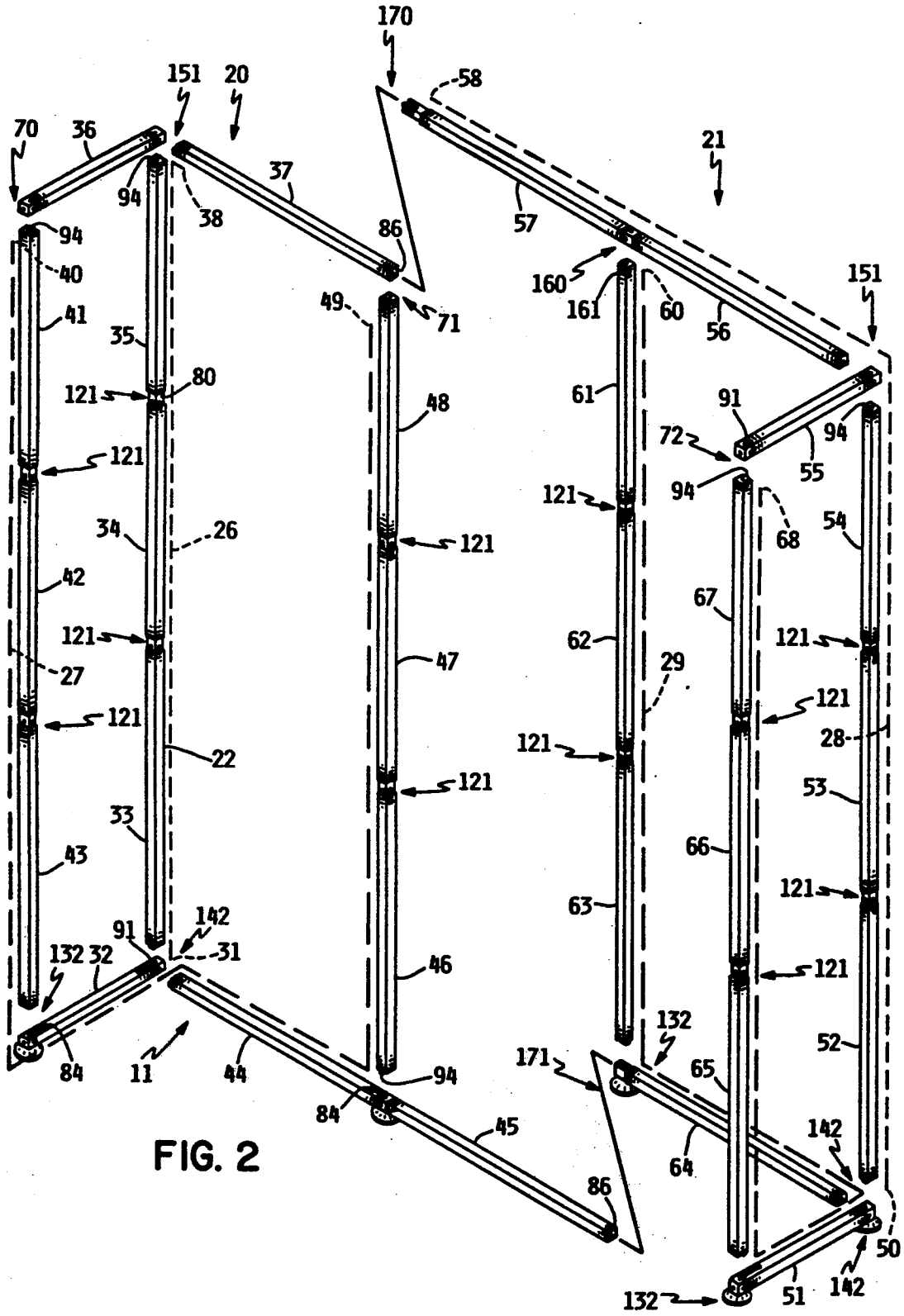
FIG. 2 is an isometric view of the frame assembly of FIG. 1 separated into two portions.

As shown in FIG. 2, the frame assembly 11 includes a pair of first and second frame assembly portions 20, 21, each of which includes a plurality of interconnected tubular support members 22. The tubular support members 22 are rigidly interconnected by male and female connectors. The tubular support members 22 are loosely but permanently interconnected by a set of elastic cords 26, 27, 28, 19 which maintain the tubular support members in a matched, predefined relationship.

Figure 5:
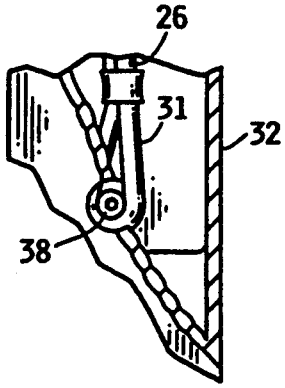
FIG. 5 is a top plan, broken-away view of a portion of one of the tubular support members of the frame assembly of FIG. 2, showing one end of the elastic cord fixed in the tubular support member.

With respect to frame assembly portion 20, a first end 31 of elastic cord 26 is fixed in horizontal tubular support member 32. The elastic cord 26 extends sequentially therefrom to and through vertical support members 33, 34, 35, and horizontal support members 36, 37 and terminates in a horizontal support member 37. A second end 38 of the elastic cord 26 is fixed in horizontal support member 37. As shown in FIG. 5, end 31 of elastic cord 26 is fixed in horizontal tubular support member 32 via a pin 38 about which end 31 is looped. Other ends of elastic cords 26–29 are also so affixed.

A first end 40 of elastic cord 27 of frame assembly portion 20 is fixed in vertical support member 41. The elastic cord 27 extends sequentially therefrom to and through vertical support members 42, 43, horizontal support member 32, horizontal support members 44, 45, and vertical support members 46, 47, and 48. A second end 49 of the elastic cord 27 is fixed in vertical support member 48.

With respect to frame assembly portion 21, a first end 50 of elastic cord 28 is fixed in horizontal support member 51. The elastic cord 28 extends sequentially therefrom to and through vertical support members 52, 53, 54, horizontal support members 55, 56, and 57. A second end 58 of the elastic cord 28 is fixed in horizontal support member 57.

A first end 60 of the elastic cord 29 is fixed in vertical support member 61. The elastic cord 29 extends sequentially therefrom to and through vertical support members 62, 63, horizontal support members 64, 51, and vertical support members 65, 66, 67. A second end 68 of the elastic cord 29 is fixed in vertical support member 67.

It should be noted that within the frame assembly portions 20, 21, certain connections or joints between some of the tubular support members 22 are not loosely engaged by any of the elastic cords 26–29. These free connections include a connection 70 between support members 36, 41, a connection 71 between support members 37, 48, and a connection 72 between support members 55, 67.

Figure 3:
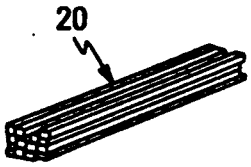
FIG. 3 is an elevation view of one portion of the frame assembly of FIG. 2 in a collapsed, compact form.
Figure 4:
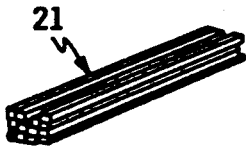
FIG. 4 is an elevation view of the other portion of the frame assembly of FIG. 2 in a collapsed, compact form.

As shown in FIGS. 3 and 4, such free connections 70–72 and the loose engagement between the other tubular support members 22 permit each of the frame assembly portions 20, 21 to be reduced for transportation and storage to a compact form in which the support members 22 lie generally parallel to each other.

As shown in FIGS. 6, 7, 9, 10, and 11, a fastening device 80 rigidly interconnects the ends of adjacent support members 72. As to the fastening device 80, U.S. Pat. No. 4,934,858 is hereby incorporated by reference.

The fastening device 80 includes a generally tubular male member 81 which is generally square in cross section with two half portions 82, 83 which are expandable and drawable together via a keyed screw 84. The male member 81 is insertable in a female square tubular end 85 of certain tubular support members 22 and expandable therein via operation of the keyed screw 84 to provide a rigid connection between the fastening device 80 and the end 85. End 85 includes a key-engaging edge 86.

Opposite of the male member 81, the fastening device 80 includes a keyed or female portion 90 which is generally tubular with a set of four keyholes 91. Each of the keyholes 91 communicates with a wider, lead or entry slot 92. Each of the keyholes 91 engages an apertured key or male end connector 94 fixed on an end of certain of the support members 22. Male end connector 94 includes a chamfer 95 having a greater width than keyhole 91 and an edge-engaging face 96. Chamfer 95 has a lesser width than lead slot 92 to be insertable directly into slot 92. To connect male end connector 94 to the female portion 90, the male end connector 94 is inserted in the lead slot 92 and then slid into keyhole 91, whereupon the chamfer 95 prevents direct removal therefrom. Subsequently, the key-engaging edge 86 of the female end 85 of the respective tubular support member 22 is slid to engage the face 96 of the key 94 to prevent removal of the male end connector or key 94 from the keyhole 91 via the lead slot 92. The edge 86 also engages a lip 97 defining the separation between keyhole 91 and lead slot 92. As the female end 86 is slid over the male member 81 to engage the key face 96, the threaded pin of the keyed screw 84 slides in a keyed screw slot 98 formed in the female end 85. After the end 86 engages the key face 96, the keyed screw 84 is tightened to provide for rigid connection between the tubular support members 22. It should be noted that the width of the chamfer 95 is greater than the width of the keyed screw slot 98 so that the key-engaging edge 86 engages the key face 96. It should be noted that slot 98 is closed to provide a continuous edge 86 to maintain fastening device 80 permanently, albeit slidingly, on end 85.

Figure 6:
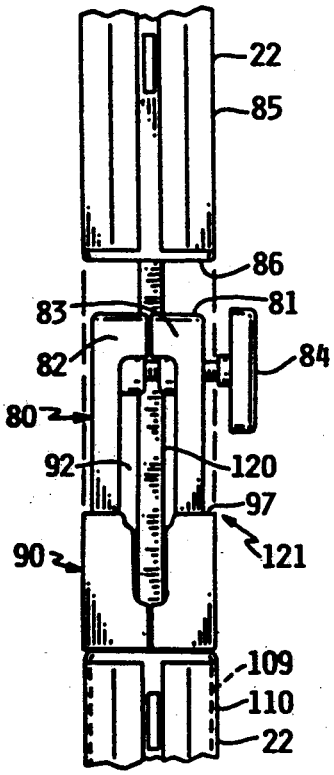
FIG. 6 is an elevation view showing a connection between two vertical support members.

It should further be noted that fastening device 80 may include a second male member 109 formed opposite of the male member 81 and extending into a female end, such as end 110 shown in FIG. 6. Such a structure is utilized between vertical support members 22. As to this second male member 109, U.S. Pat. No. 4,934,858 is hereby incorporated by reference.

Figure 7:
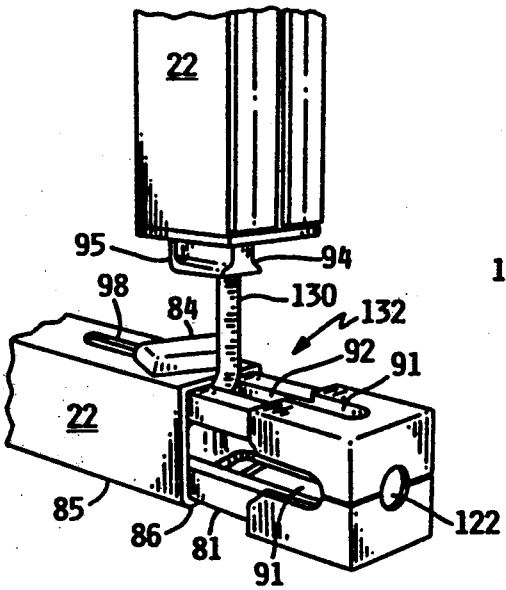
FIG. 7 is an isometric view showing a connection between a vertical support member and a horizontal support member.

As further shown in FIG. 6, an elastic cord portion 120 extends between vertical support members to loosely engage such vertical support members. As to such connections, U.S. Pat. No. 4,934,858 is hereby incorporated by reference. Such connections are indicated by the reference arrow 121 in FIG. 2. It should be noted that not only are the vertical support members 22 of FIG. 6 permanently matched via the elastic cord portion 120, but that also the relative orientations of adjacent vertical support members 22 are matched by the provision of only one slot 98 for the keyed screw 84. As shown in FIG. 7, the fastening device 80 includes an aperture 122 for the elastic cord portion 120.

Figure 8:
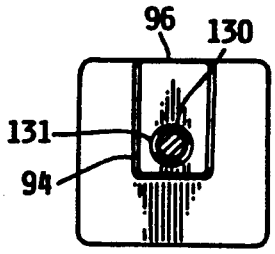
FIG. 8 is an end view of the vertical support member of FIG. 7.

As shown in FIGS. 7 and 8, an elastic cord portion 130 extends from a female end 85, through a lead hole 92 which communicates with a keyhole or female receptor 91, and through an aperture 131 formed in one of the keys 94 and extending into its respective support member 22. From the aperture 131, the elastic cord portion 130 subsequently extends at least partially through the respective support member 22. Accordingly, the key 94 is matched permanently not only with another support member 22, but also with a particular keyhole 91 of such support member 22 such that the relative orientations of the adjacent support members 22 are permanently matched. The connections or corner joints between horizontal and vertical support members 22 as shown in FIG. 7 are indicated in FIG. 2 by reference arrows 132.

Figure 9:
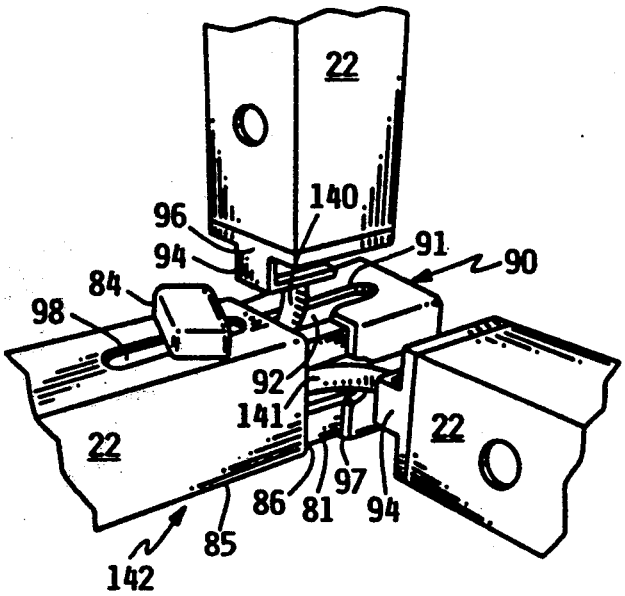
FIG. 9 is an isometric view showing a two-cord connection among two horizontal support members and a vertical support member.

As shown in FIG. 9, an elastic cord portion 140 extends from the apertured key 94, through lead hole 92 which communicates with its respective keyhole 91, and subsequently into the female end 85 of the respective support member 22. Another elastic cord portion 141 extends from an apertured key 94 of another tubular support member 22 into a different lead hole 92 and keyhole 91, but into the same female end 85. Such connections or tripartite joints are indicated in FIG. 2 by reference numerals 142. As with the connections 121 and 132, connections 142 maintain the relative orientations among the three support members 22.

Figure 10:
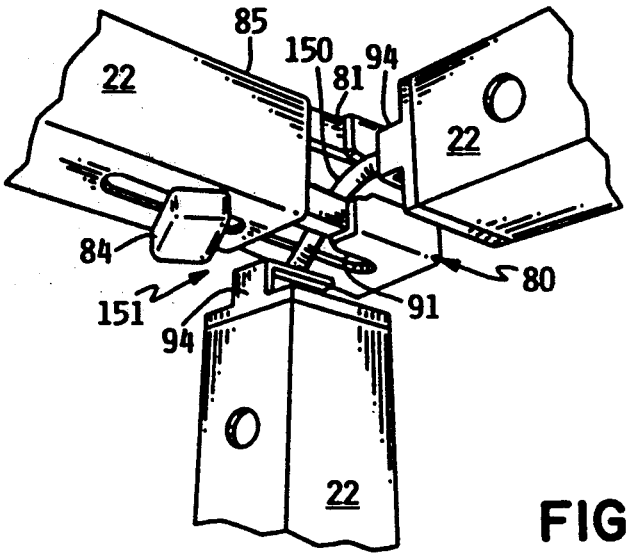
FIG. 10 is an isometric view showing a one-cord connection among two horizontal support members and a vertical support member.

As shown in FIG. 10, an elastic cord portion 150 extends from one apertured key 94 of one support member 22, through a lead hole 92 and keyhole 91 of one fastening device 80, out of another lead hole 92 and keyhole 91 of the same fastening device 80, and into an apertured key 94 of another support member 22. Such connections or tripartite joints are indicated in FIG. 2 by reference numerals 151. As with connections 121, 132, and 142, connections 151 maintain the relative orientations among the three respective support members 22.

Figure 11:
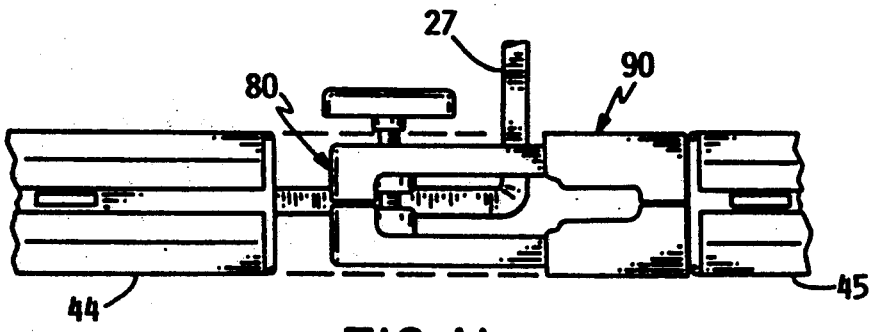
FIG. 11 is an elevation view showing a one-cord connection between two linearly disposed horizontal support members which are to be connected to a vertical support member.

A portion of the tripartite connection between support members 44, 45 and 46 is shown in FIG. 11. Here the cord 27 extends from a lead hole 92 to an apertured key 94 of vertical member 46 which is not shown in FIG 11. Fastening device 80 of this connection includes the second male member 109.

It should be noted that a connection 160, as shown in FIG. 2, includes a free end 161 of support member 61. This free end 161 is affixed into the fastening device 80 between support members 56, 57. This fastening device 80 includes the extra male member 109, like connection 121, to add support to the top of the frame assembly 11.

To connect the frame assembly portions 20, 21 to form the frame assembly 11, connections 170, 171 are established. Connection 170 is disposed between support members 37, 48 and 57. Such a connection 170 includes the fastening device 80 with the extra male member 109. Connection 171 is disposed between support members 45, 63, and 64 and also includes the extra male member 109.

In operation, to construct the frame assembly portions 20, 21 from the compact forms shown in FIGS. 3, 4, the male members 81 are inserted into their respective female ends 85, and the keys or male members 94 are inserted into their respective key holes or female receptors 91. The female ends 85 are then slid to engage the keys 94 and the keyed screws 84 are subsequently tightened to expand the male members 81 to rigidify the connections between the respective tubular members 22. The connections 170, 171 are then established to form the frame assembly 11. With the exception of connections 70, 71, 72, 160, 170, and 171, the connections between adjacent ends of the respective tubular support members are maintained in their relative orientations by the elastic cords 26–29. Hence, assembly of the frame assembly 11 into the desired configuration is facilitated as such as configuration has been predefined by the elastic cords 26–29.

It should be noted that the cords 26–29 are preferably elastic to draw respective support members together and such that the cords 26–29 themselves are drawn into the support members to out-of-the-way positions so as to avoid interfering with the connections between the support members. However, if desired, the cords 26–29 may be nonelastic.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A frame assembly for a display structure, comprising:

(a) a plurality of tubular support members having adjacent ends which are joinable to form the frame assembly, each of the adjacent ends of the tubular support members being interlockable by a male and female connection having male and female portions;

(b) at least two of the tubular support members being joinable to each other at an angle to define a pair of angular tubular support members;

(c) the male and female connection of the angular tubular support members further comprising a cord between its respective male portion and the female portion to match such portions to each other to facilitate set up of the frame assembly; and (d) at least some of the male and female connections comprising key and keyhole connections, the key of at least some of the key and keyhole connections including an aperture, the cord extending through the aperture to and through the keyhole cooperating with the key to match the key to its respective keyhole to further facilitate set up of the frame assembly.

2. The frame assembly of claim 1, further comprising another pair of angular tubular support members, the cords of the pairs of angular tubular support members being integral with each other.

3. The frame assembly of claim 2, wherein at least two of the tubular support members are joinable to each other linearly to define a pair of linear tubular support members, the male and female connection of the pair of linear tubular support members further comprising a cord between its respective male portion and female portion to match such portions to each other to facilitate set up of the frame assembly.

4. The frame assembly of claim 3, further comprising another pair of linear tubular support members, the cords of the pairs of linear tubular support members being integral with each other.

5. The frame assembly of claim 4, wherein the cords of the pairs of angular and linear tubular support members are integral with each other.

6. The frame assembly of claim 5, wherein each of the ends having one of the male portions also includes an aperture adjacent to such male portion, the cord extending from the aperture to the female portion of the respective male and female connection.

7. The frame assembly of claim 6, further comprising adjustment means adjacent to each of the male and female connections for adjusting the rigidity of the connections.

8. The frame assembly of claim 7, wherein the adjustment means comprises means for expanding one portion of each of the connections against another portion of its respective connection.

9. The frame assembly of claim 1, wherein the cord is elastic.

10. A frame assembly for a display structure, comprising:

(a) a plurality of tubular support members having adjacent ends which are joinable to form the frame assembly, each of the adjacent ends of the tubular support members being interlockable by a male and female connection having male and female portions;

(b) at least some of the male and female connections comprising key and keyhole connections, the key of at least some of the key and keyhole connections including an aperture; and (c) a cord extending between at least some of the key and keyhole connections and to and through the apertures and keyholes of such key and keyhole connections to match the respective key to its respective keyhole to facilitate set up of the frame assembly.

11. The frame assembly of claim 10, wherein the female connection further comprises a lead slot which is greater in width than the keyhole and which leads into the keyhole for initial acceptance of its respective key.

12. The frame assembly of claim 11, wherein at least two of the tubular support members are joinable to each other at an angle to define a pair of angular tubular support members, at least some of the angular tubular support members being joinable by the key and keyhole connections.

13. The frame assembly of claim 10, wherein the cord is elastic.

* * * * *